US009901152B2

(12) United States Patent
Camurati et al.

(10) Patent No.: US 9,901,152 B2
(45) Date of Patent: Feb. 27, 2018

(54) HANDLE BAG

(71) Applicant: HERMES SELLIER, Paris (FR)

(72) Inventors: Angela Camurati, Valmadonna (IT); Luca Valerani, Valenza (IT); Carlo Traglio, Milan (IT)

(73) Assignee: HERMES SELLIER, Paris (FR)

( * ) Notice: Subject to any disclaimer, the term of this patent is extended or adjusted under 35 U.S.C. 154(b) by 0 days.

(21) Appl. No.: 15/290,246

(22) Filed: Oct. 11, 2016

(65) Prior Publication Data

US 2017/0027295 A1 Feb. 2, 2017

Related U.S. Application Data

(62) Division of application No. 13/724,108, filed on Dec. 21, 2012, now abandoned.

(30) Foreign Application Priority Data

Jan. 18, 2012 (IT) ..... RM2012A0016

(51) Int. Cl.

| | |
|---|---|
| ***A45C 3/06*** | (2006.01) |
| ***A45C 13/08*** | (2006.01) |
| ***A44C 5/00*** | (2006.01) |
| ***A44C 27/00*** | (2006.01) |
| ***A44C 15/00*** | (2006.01) |

(52) U.S. Cl.

CPC ..... *A45C 13/08* (2013.01); *A44C 5/00* (2013.01); *A44C 5/0007* (2013.01); *A44C 15/005* (2013.01); *A44C 27/00* (2013.01); *A45C 3/06* (2013.01); *Y10T 29/49588* (2015.01)

(58) Field of Classification Search

CPC ..... A45C 3/06; A45C 13/08; A44C 15/005
USPC ..... 150/100, 125
See application file for complete search history.

(56) References Cited

U.S. PATENT DOCUMENTS

| | | | | |
|---|---|---|---|---|
| 1,032,328 A | | 7/1912 | Foster | |
| 2,381,860 A | * | 8/1945 | Baggott | A45C 13/083 150/127 |
| 2,440,474 A | * | 4/1948 | Jackler | A45C 13/083 150/127 |

(Continued)

FOREIGN PATENT DOCUMENTS

| | | |
|---|---|---|
| CH | 696957 | 2/2008 |
| DE | 1460162 | 3/1969 |

(Continued)

OTHER PUBLICATIONS

Italian Search Report, dated Sep. 25, 2012, from corresponding Italian application.

(Continued)

*Primary Examiner* — Sue A Weaver
(74) *Attorney, Agent, or Firm* — Young & Thompson

(57) ABSTRACT

An article of jewelry includes a first panel (2) and a second panel (3) facing the first panel (2) and being both formed by a plurality of single pieces (4, 5) which are distinct from each other, first linking elements (20) being configured to rigidly assemble the single pieces (4, 5) respectively of first and second panels (2, 3) which face and second linking elements (21) being each configured to assemble at least two the single pieces (4, 5) of the first panel (2) or the second panel (3) so that the two single pieces (4, 5) are movable with respect to each other.

9 Claims, 6 Drawing Sheets

(56) References Cited

U.S. PATENT DOCUMENTS

| | | | | |
|---|---|---|---|---|
| 2,601,094 | A | 6/1952 | Corbi | |
| 3,009,597 | A * | 11/1961 | Martin | E04F 13/0862 150/127 |
| 3,469,749 | A | 9/1969 | Tabata | |
| 4,671,055 | A | 6/1987 | Tschanz et al. | |
| 5,186,569 | A | 2/1993 | Wu | |
| 6,708,745 | B2 * | 3/2004 | Huang | A45C 13/04 150/120 |
| 2014/0000313 | A1 | 1/2014 | Barbazza | |
| 2016/0174672 | A1 * | 6/2016 | Nie | A45C 3/06 150/127 |

FOREIGN PATENT DOCUMENTS

| | | |
|---|---|---|
| EP | 1911366 | 4/2008 |
| FR | 2263877 | 10/1975 |
| GB | 1491532 | 11/1977 |
| WO | 0172163 | 10/2001 |
| WO | 2012127511 | 9/2012 |

OTHER PUBLICATIONS

English Translation of Chinese Office Action, dated May 13, 2014, from corresponding CN application.

* cited by examiner

Fig. 5
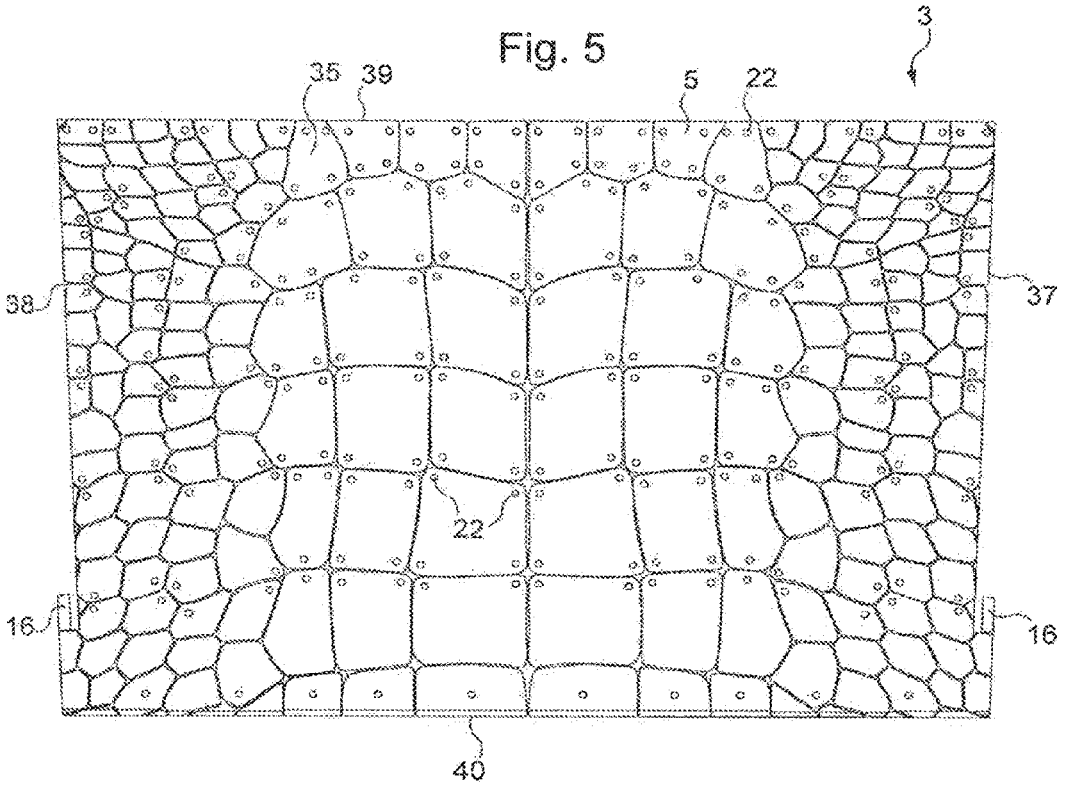
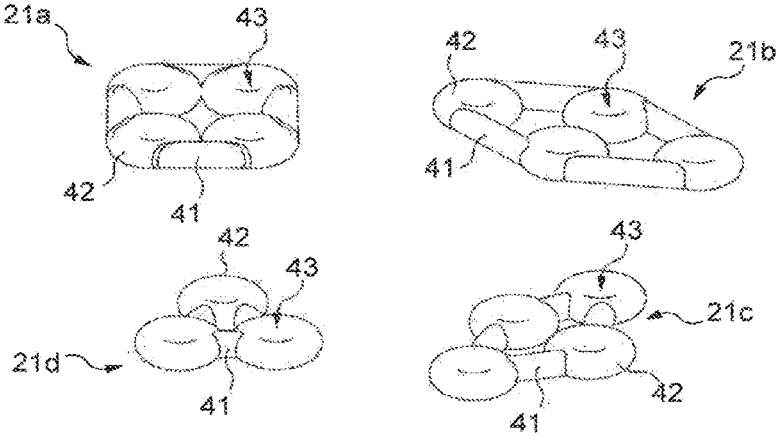
Fig. 6

HANDLE BAG

FIELD OF THE INVENTION

The invention relates to articles of jewelry, for instance a bag handle or a watch, in particular, a wrist watch strap, necklace, or bracelet. The articles of jewelry may or may not be made from a precious metal. For instance, the invention relates to articles of jewelry having a crocodile skin aspect.

The invention further relates to methods for manufacturing such articles of jewelry.

BACKGROUND ART

Articles of jewelry, in particular bag handles or wrist watch straps, with a crocodile skin aspect are well known.

The crocodile skin aspect is generally provided with only one plate made from metal or leather. The plate has an upper face and a lower face opposite the upper face and has a plurality of ribs provided to both the upper and lower faces. The ribs are configured to reveal a design of the type crocodile skin aspect. Such known articles of jewelry have a rigid crocodile skin aspect.

The invention is directed to an article of jewelry having a natural crocodile skin aspect, which is simple to manufacture, and a method for manufacturing such an article, which is simple to implement, convenient, and economic.

SUMMARY OF THE INVENTION

The invention accordingly provides an article of jewelry comprising a first panel and a second panel facing the first panel, both panels being formed by a plurality of single pieces that are distinct from each other, first linking elements being configured to rigidly assemble the single pieces respectively of first and second panels which face each other and second linking elements being each configured to assemble at least two the single pieces of the first panel or the second panel so that the two single pieces are movable with respect to each other.

The invention is based on the observation that the natural skin aspect for instance of a crocodile or a snake is due to the fact single pieces, also named scales, move relatively freely in relation to one to another.

The single pieces of the first panel are each distinct from each other, and it is the same for the single pieces of the second panel. Further, the assembly of the single pieces of the first panel with the single pieces of the second panel is obtained thanks to the first linking elements which rigidly assemble the single pieces which face. Thus, a relatively flat plate is obtained, the plate having for instance a crocodile skin aspect.

Thanks to the second linking elements which areeach linked with at least two single pieces of at least one of the first panel and the second panel, the article allows the two single pieces to move relatively with respect to each other.

Since the single pieces of the first panel or of the second panel are assembled with a relative mobility, and since the single pieces of the first panel and the second panel are rigidly assembled, the article of jewelry according to the invention provides a natural skin aspect for instance of crocodile.

According to features preferred as being very simple, convenient and economical for embodying the article according to the invention:

- the second linking elements are each configured to cooperate with at least two of the first linking elements;

- the second linking elements are each configured to assemble between two and six single pieces of either first or second panels;
- the first linking elements are formed by pins which project from the first panel and which are configured to be fixed to the second panel;
- the second panel comprises a plurality of holes each being configured to receive a free end of a pin;
- at least one of the second linking elements is formed by a frame having at least two eyes, each eye being configured to surround a pin;
- the first and second panels each have a plurality of single pieces which are of different shapes;
- the single pieces of the first panel which face the single pieces of the second panel have similar outlines;
- the article has a general rectangular shape comprising a middle zone and two lateral zones and the single pieces in the middle zone have each an outline defining a perimeter which is similar to the perimeter defined by an outline of each of the single pieces in the lateral zones;
- each single piece of first and second panels is assembled to other single pieces by at least two first linking elements and by at least two second linking elements;
- the article has two lateral faces and a flange which projects from the first panel and covers partially the second panel; and/or
- the article is at least partially made from a precious metal.

The invention further provides a method for manufacturing an article of jewelry as described above, comprising the following steps:

- providing a first panel having a plurality of single pieces and having first linking elements on the single pieces;
- providing a second panel having a plurality of single pieces;
- providing second liking elements;
- mounting the second linking elements on the first linking elements to assemble at least two the single pieces of the first panel so that the two single pieces are moveable with respect to each other;
- facing the first panel to the second panel; and
- fixing the first linking elements to the second panel to rigidly assemble the single pieces respectively of the first and second panels which face The method according to the invention is simple to implement, convenient and economic.

According to features preferred as being very simple, convenient and economical for embodying the article according to the invention:

- the first linking elements are formed by pins and the second panel comprises holes configured to receive free end of the pins and the step of fixing the pins to the second panel is made by welding; and/or
- the method further comprises a step of polishing an outer face of the second panel.

BRIEF DESCRIPTION OF THE DRAWINGS

The description of the invention continues now with a detailed description of a preferred embodiment given hereinafter by way of non-limiting illustration and with reference to the appended drawings. In these drawings:

FIGS. 4 and 5 are bottom views respectively of the first panel and of the second lower panel shown in FIG. 3;

FIG. 6 is a perspective view of second linking elements shown in FIG. 1.

DETAILED DESCRIPTION OF PREFERRED EMBODIMENTS

Figure 1:
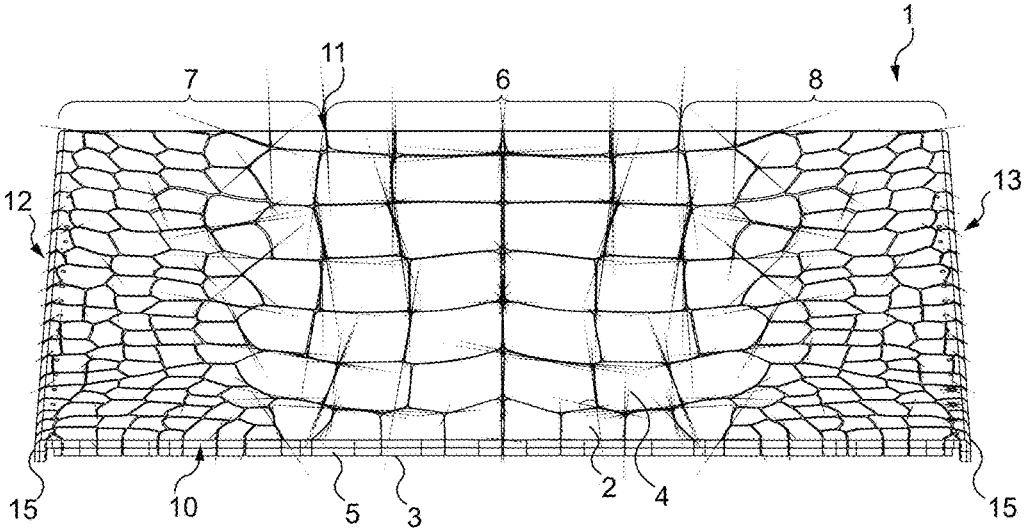
FIGS. 1 and 2 are perspective views of an article of jewelry according to the invention, respectively in a first position and in a second position.
Figure 2:
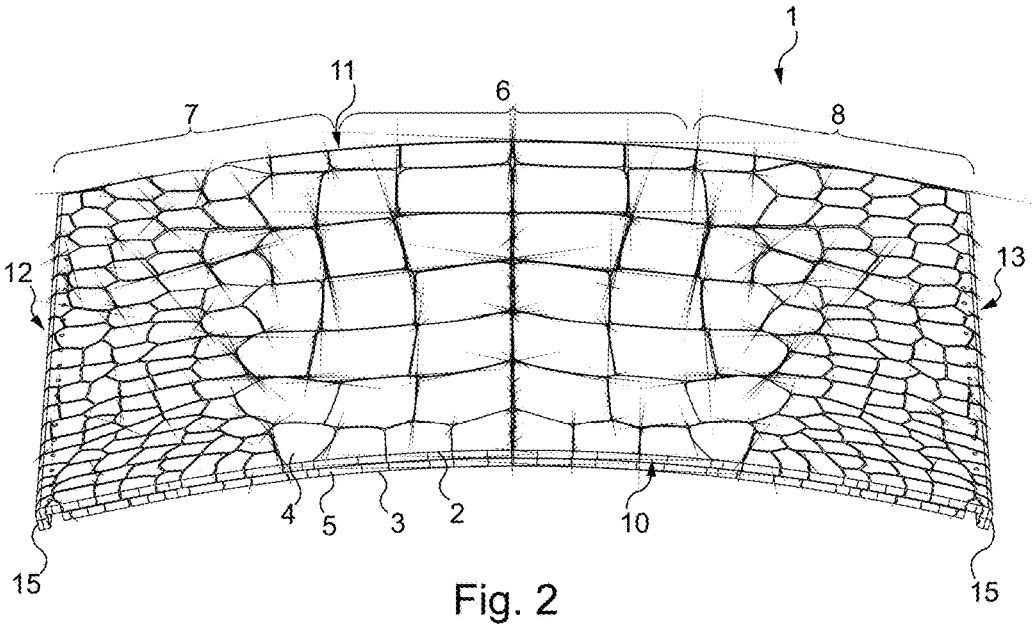

FIGS. 1 and 2 show an article of jewelry 1, forming at least one side of a handle bag, in two distinct positions, respectively flat and not flat (or incurved).

The article of jewelry 1 is here made from a precious metal, for instance gold.

The article 1 has a natural crocodile skin aspect.

The article 1 comprises an upper first panel 2 and a lower second panel 3 which are both made from gold.

The first and second panels 2 and 3 each comprise a plurality of single pieces 4 and 5.

The first and second panels 2 and 3 each have a generally rectangular shape comprising a middle zone 6 and two lateral zones 7 and 8.

The first panel 2 faces the second panel 3 and the single pieces 4 thus face the single pieces 5.

The single pieces 4 and 5 which face have similar outlines.

The single pieces 4, respectively 5, of the first panel 2, respectively of the second panel 3, have not all the same shapes and since they are of different shapes, they also have different outlines.

As shown on FIGS. 1 and 2, the different outlines and shapes of the single pieces 4, respectively 5, reproduced a crocodile skin aspect.

The single pieces 4 and 5 which are situated in the middle zone 6 of the article 1 have each an outline defining a perimeter which can be similar to the perimeter defined by the outline of each of the single pieces 4 and 5 situated in the lateral zones 7 and 8.

In variant, the single pieces 4 and 5 situated in the lateral zones 7 and 8 have each an outline defining a perimeter which can be smaller or larger than the perimeter defined by the outline of each of the single pieces 4 and 5 in the middle zone 6.

The article 1 has a front face 10, a rear face 11 and two lateral faces 12 and 13.

The article 1 extends longitudinally between the lateral ends 12 and 13 (defining a longitudinal axis) and comprises an axis of symmetry perpendicular to the longitudinal axis and situated in the middle zone 6.

Thus, the single pieces 4 and 5 situated in the lateral zone 7 have the same shapes than the shapes of the single pieces 4 and 5 situated in the lateral zone 8.

The article 1 further comprises flanges 15 which project from the first panel 2.

FIG. 1 shows the article 1 as being a flat plate and FIG. 2 shows the article 1 as being a curved plate.

FIG. 2 shows that the single pieces 4 and 5 of the article 1 are movable with respect to each other.

We now describe in details the article 1 with reference to FIGS. 3 to 7.

The article 1 further comprises first linking elements and second linking elements.

The first panel 2 has an outer face 25, an inner face 26 opposite to the outer face 25, two opposite lateral ends 27 and 28, a front end 29 and a rear end 30.

Figure 3:
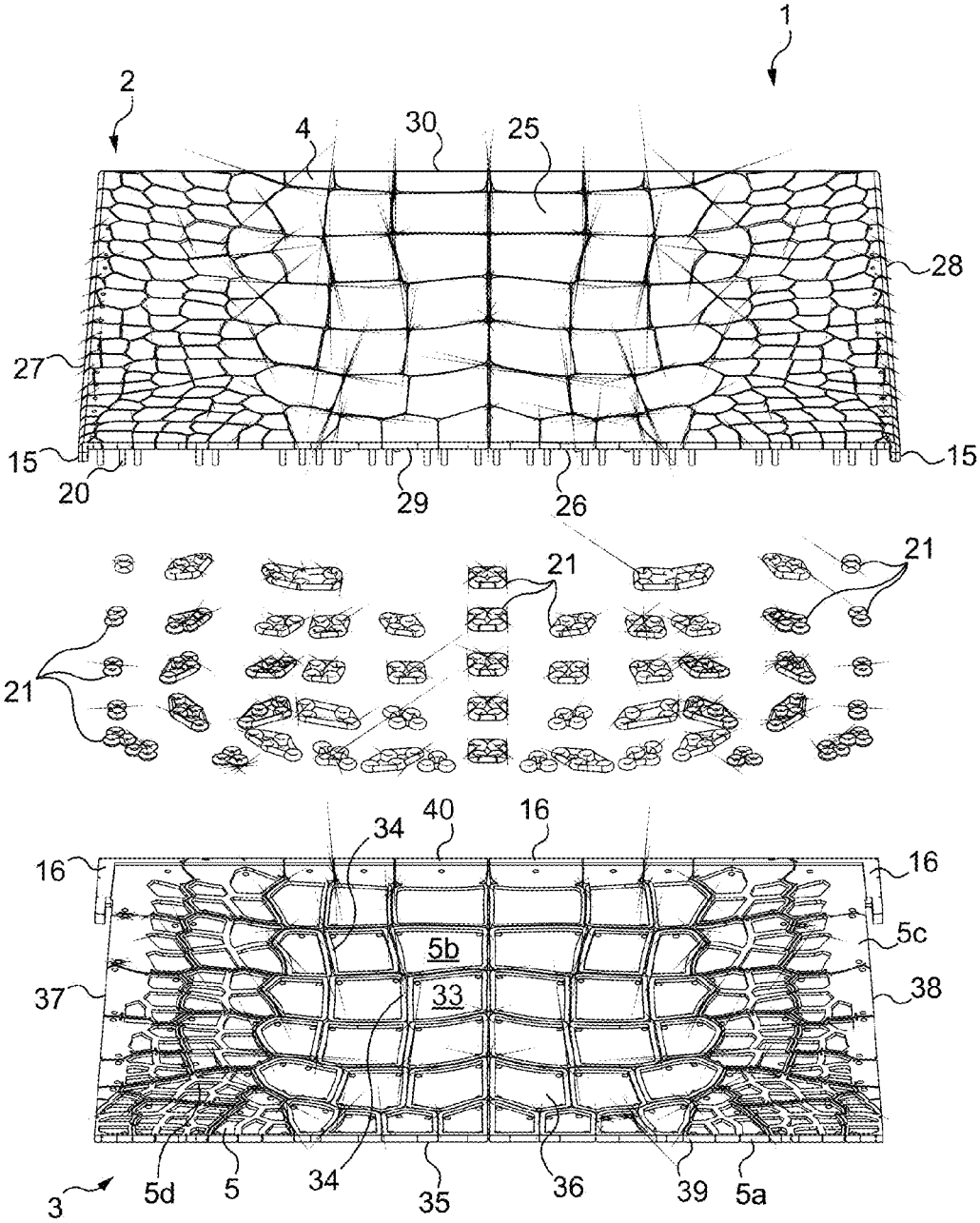
FIG. 3 is an exploded perspective view of the article illustrated in FIG. 1, showing a first panel, second linking elements and a second lower panel.
Figure 4:
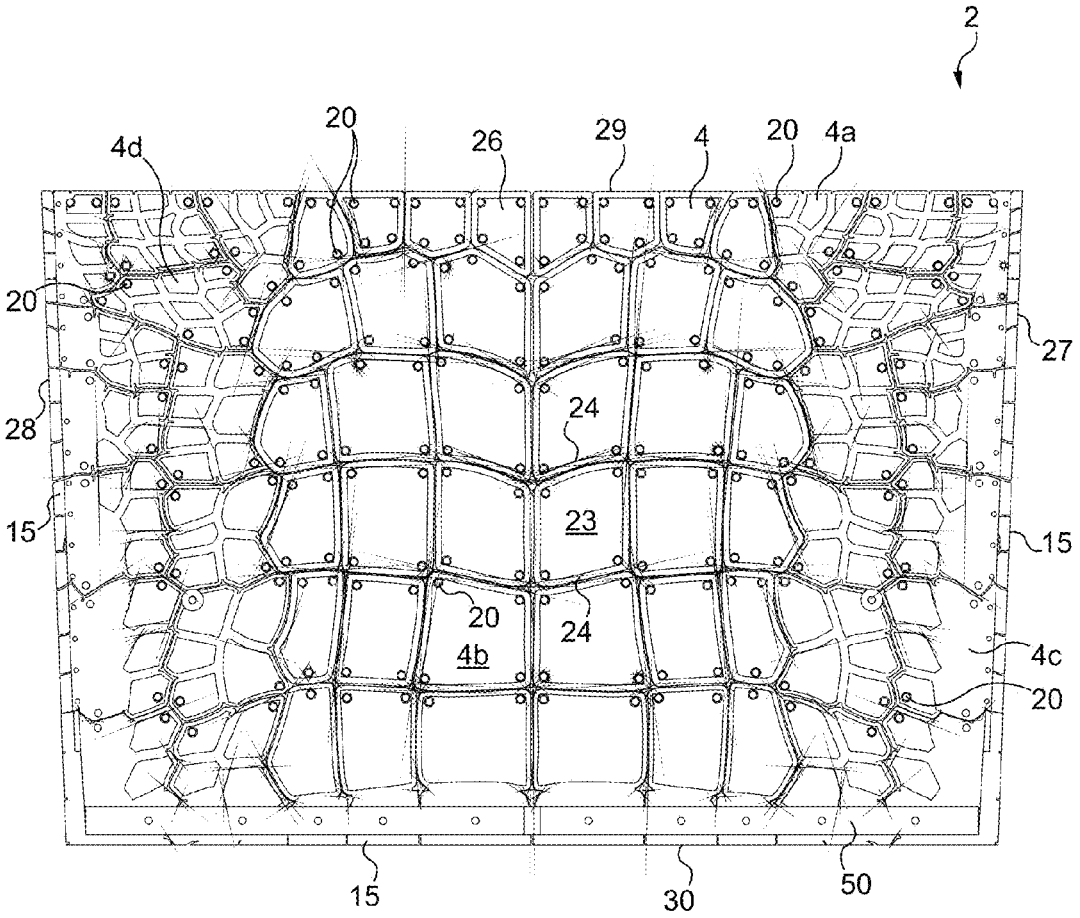

Here, the first linking elements are formed by pins 20 which project from the inner face 26 of the first panel 2, as shown on FIGS. 3 and 4.

Each pin 20 has a cylindrical shape or a slightly truncated shape with the section of the free end of the pin 20 which is smaller than the section of the pin 20 where it projects from the inner face 2 of the first panel 2.

The flanges 15 which project from the lateral ends 27 and 28 and from the rear end 30 are here formed each with a respective single piece 4.

Here, the pins 20 are also formed with the respective single piece 4 from which each pin 20 projects.

FIG. 4 shows that the single pieces 4 have different shapes and thus have outlines which define different perimeters.

For instance, the single piece 4*a* is at the front end 29 and has a shape which includes six scales. The single piece 4*a* further comprises four pins 20.

For instance, the single piece 4*b* is in the middle zone 6 and has a shape which includes only one scale (bigger than the scales of the single piece 4*a*) and further comprises four pins 20.

The single piece 4*c* is situated at the lateral end 27 and has a shape which includes three scales and also a part of the flange 15. The single piece 4*c* also comprises two pins 20.

The single piece 4*d* is situated in a lateral zone 8 of the article 1 and has a shape which includes nine scales and also comprises six pins 20.

Each single piece 4 is provided with a central recess 23 defining a peripheral wall 24.

The pins 20 are here disposed along outline of each single piece 4, for instance at the corners and in particular along the peripheral wall 24 in the recess 23.

The second lower panel 3 has an outer face 35, an inner face 36 opposite to the outer face 35, two opposite lateral ends 37 and 38, a front end 39 and a rear end 40.

The first panel 2 further comprises a band of material 50 configured to link both the first panel 2 and the second lower panel 3 (which form a side of the handle bag) with the bottom of the handle bag.

The second lower panel 3 also comprises a flange support 16 situated at the rear end 40 and partially at the lateral ends 37 and 38 and the flange support 16 is configured to support the flange 15 when the latter comes into abutment against the flange support 16.

The support flange 16 which project from the rear end 40 and from the lateral ends 37 and 38 are here formed with a respective single piece 5.

FIGS. 3 and 5 show that each single piece 5 comprises holes 22.

The holes 22 through the material of the second lower panel 3.

FIG. 5 further shows that the single pieces 5 have different shapes and thus have outlines which define different perimeters.

For instance, the single piece 5*a* is at the front end 39 and has a shape which includes six scales. The single piece 5*a* further comprises four holes 22. Single piece 5*a* is configured to face the single piece 4*a* of the first panel 2.

For instance, the single piece 5*b* has a shape which includes only one scale (bigger than the scales of the single piece 5*a*) and further comprises four holes 22. Single piece 5*b* is configured to face the single piece 4*b* of the first panel 2.

The single piece 5*c* is situated at the lateral end 37 and has a shape which includes three scales and also a part of the flange support 16. The single piece 5*c* also comprises two holes 22. The single piece 5*c* is configured to face the single piece 5*c* of the first panel 2.

The single piece 5*d* is situated in a lateral zone 8 of the article 1 and has a shape which includes nine scales and also comprises six holes 22. Single piece 5*d* is configured to face the single piece 4*d* of the first panel 1.

Each single piece 5 is provided with a central recess 33 defining a peripheral wall 34.

The holes 22 are here disposed along the outline of each single piece 5, for instance at the corners and in particular along the peripheral wall 34 in the recess 33.

The holes 22 are configured to face the pins 20 of the first panel 2.

The holes 22 are also configured to receive the free end of the pins 20 situated on the single pieces 4 which face the single pieces 5 in which are made the holes 22.

When the free ends of the pins 20 are introduced into the holes 22, the first panel 2 and the second lower panel 3 are fixed together and in particular, the single pieces 4 of the first panel 2 are rigidly assembled with the single pieces 5 of the second lower panel 3 which face the single pieces 4.

Each pin 20 is thus configured to rigidly assemble the single pieces 4 which face the single pieces 5.

The second linking elements are here formed by a frame 21 which comprises a plurality of arms 41 which are interconnected with eyes 42.

FIG. 6 shows different frames 21*a-d*.

The frame 21*a* has a rectangular shape. The frame 21*a* comprises four arms 41 having each a toric section and four eyes 42 having each a toric section too.

Each arm 41 is connected to two eyes 42 and each eye 42 is thus connected to two arms 41.

The eyes 42 have each a central aperture 43 which through the center of the eyes 42.

The frame 21*b* is almost similar to the frame 21*a* except that the frame 21*b* has a rhomb shape.

The frame 21*c* is almost similar to the frames 21*a* and 21*b* except that the frame 21*c* has neither a rectangular shape nor a rhomb shape but rather a shape of parallelepiped.

The frame 21*d* has a triangular shape and comprises three arms 41 and three eyes 42 which each comprise an aperture 43.

Each arm 41 of the frame 21*d* is connected to two eyes 42 and each eye 42 is connected to two arms 41.

The apertures 43 of the frames 21*a-d* have a diameter corresponding to the section of the pins 20.

Figure 7:
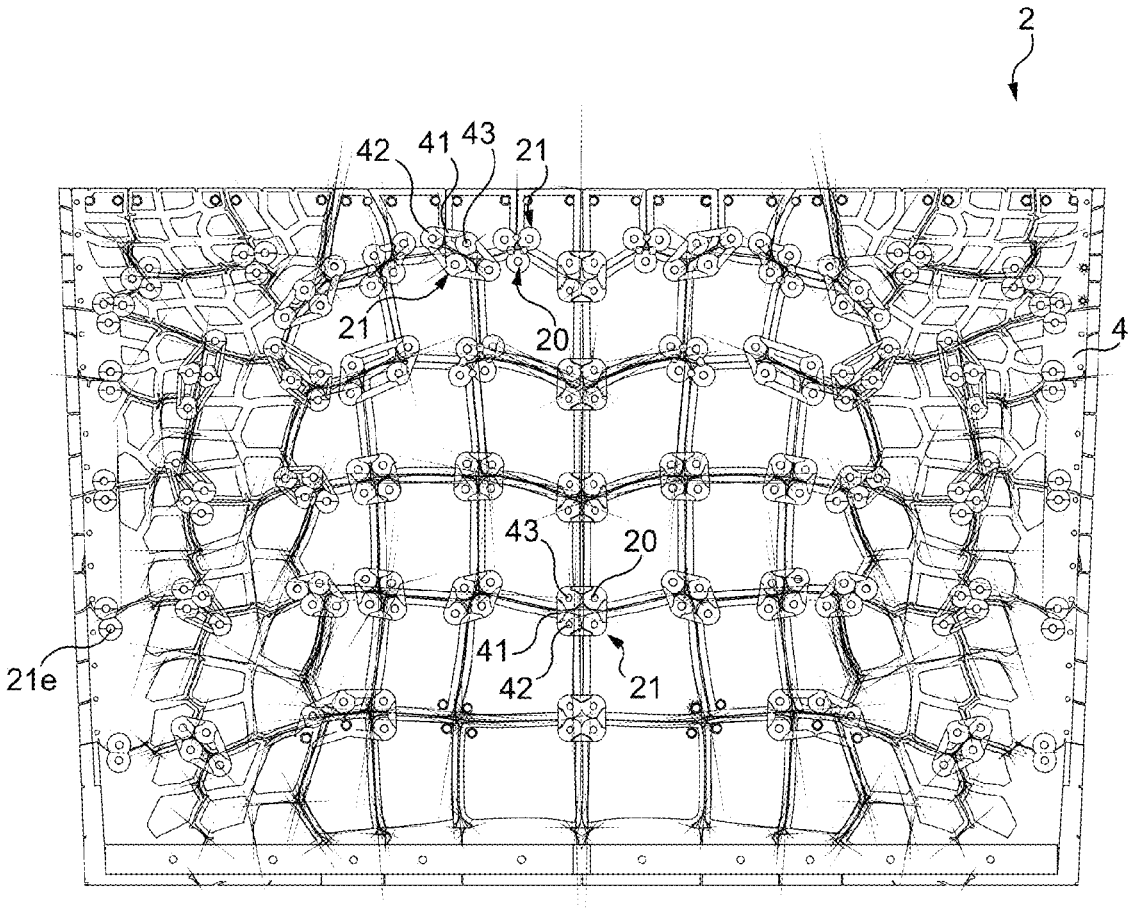
FIG. 7 is a view similar to FIG. 4 showing the first panel on which second linking elements are mounted.
Figure 8:
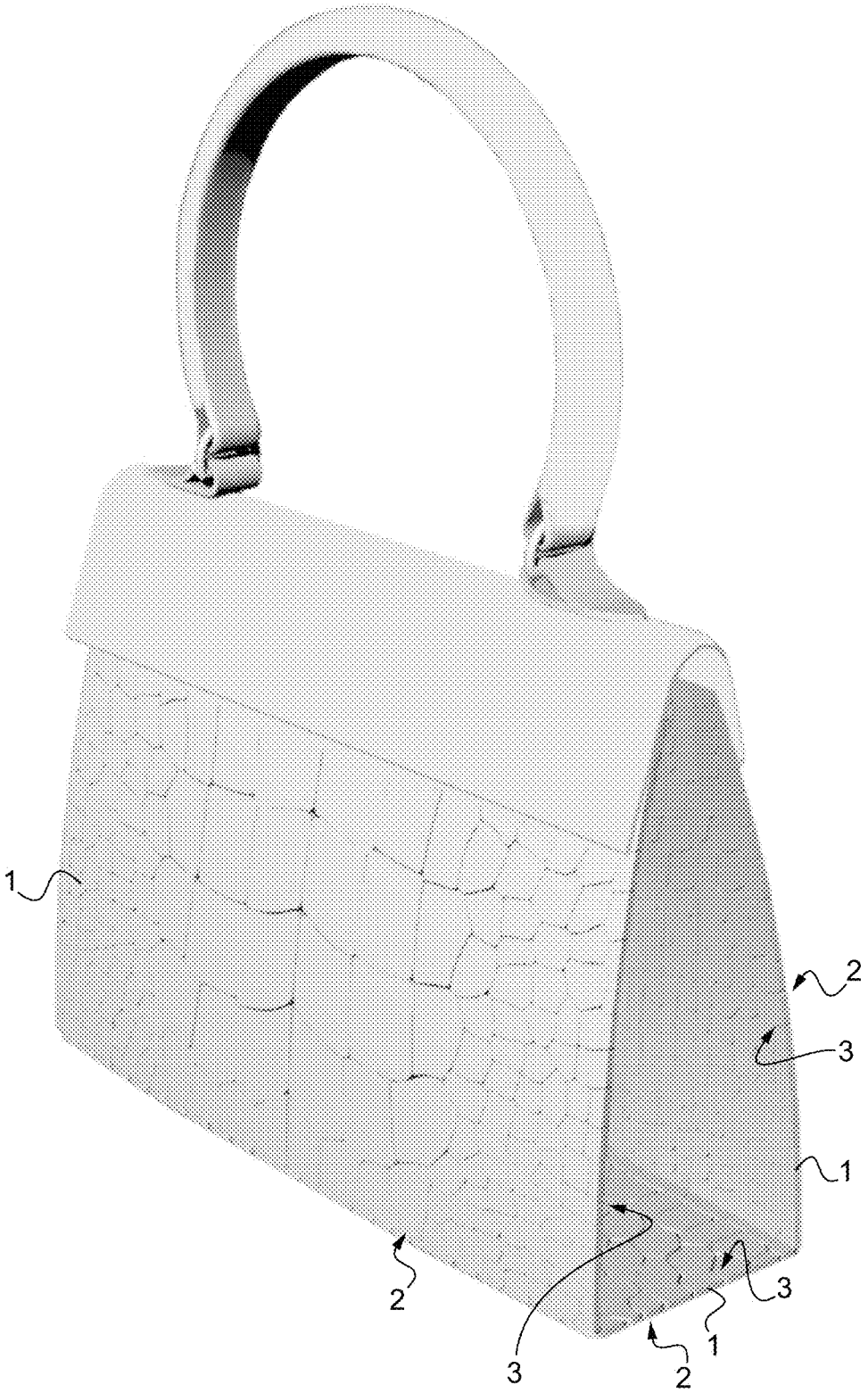
FIG. 8 shows a handle bag with sides made from the article of jewelry of FIGS. 1 and 2.

Each eye 42 is configured to surround a pin 20, as shown on FIG. 7.

The frames 21 are each mounted on a plurality of pins 20, depending on the number of eyes 42 of the frame 21 and depending on the shape of the frame 21.

FIG. 7 further shows frame 21 having only two eyes 42, this frame being also named 21*e*. The frame 21*e* does not comprise arm.

FIG. 7 shows that the frames 21 are each configured to cooperate with at least two pins 20.

In particular, the frames 21 are each configured to cooperate with two to six pins 20, which pins 20 each project from distinct single pieces 4 of the first panel 2.

Thus, each frame 21 is configured to assemble at least two single pieces 4 of the first panel 2 so that the at least two single pieces 4 are movable with respect to each other.

Indeed, each aperture 43 of the frames 21 is configured so that the pin 20 which is introduced into the aperture 43 can move due to a relative gap.

We will now describe the method for manufacturing such article of jewelry 1.

First, the single pieces 4 of the first panel 2 which are distinct are placed next to each other to form the desired pattern, in other word a crocodile skin aspect.

The pieces 4 which define the bigger scales are placed in the middle zone 6 and the pieces 4 which define the smaller scales are placed in the lateral zones 7 and 8 near the middle zone 6.

The frames 21 are each mounted on the pins 20 of the first panel 2, depending on the shape of the frames 21, on the number of eyes 42 of the frames 21 and on the configuration of pins 20.

The frames 21 are mounted on the pins 20 until the free end of each pin 20 through an aperture 43 of an eye 42.

In the pre-assembled state, the single pieces 4 of the first panel 2 are linked together thanks to the pins 20 and to the frames 21. The single pieces 4 can move with respect to each other.

Next, the single pieces 5 of the second lower panel 3 which are distinct are placed next to each other to form the desired pattern, in other word a crocodile skin aspect too.

The pieces 5 which define the bigger scales are placed in the middle zone 6 and the pieces 5 which define the smaller scales are placed in the lateral zones 7 and 8 near the middle zone 6.

The first panel 2 and the second lower panel 3 are then placed so that they are facing and in particular each single piece 4 faces a single piece 5 which has a similar outline.

In the pre-assembled state, the pins 20 face the holes 22.

The first and second panels 23 are clamped so that the pins 20 are each introduced into a respective hole 22.

The first and second panels 2 and 3 are clamped until the free end of each pin 20 slightly projects from the outer face 35 of the second lower panel 3 (through the holes 22).

A step of welding the pins 20 into the holes 22 is carried out in order to fix the pins 20 in the holes 22 and thus in order to fit the first panel 2 with the second lower panel 3.

Finally, a step of polishing the outer face 35 of the second lower panel 3 is carried out in order to remove burrs from the step of welding (close to the holes 22).

The article of jewelry 1 is thus manufactured so that the single pieces 4 and 5 which face are rigidly assembled and with the single pieces 4, respectively 5, of the first panel 2, respectively of the second lower panel 3, which are movable with respect to each other.

Further, the flanges 15 covers the lateral ends 37 and 38 of the second lower panel 3 and come into abutment against the flange support 16 of the second lower panel 3.

The article 1 made from gold material and manufactured according to the method described above provides a natural crocodile skin aspect, in other word with the scales which are not rigid and static but rather which are movable with respect to each other.

In variants that are not illustrated:

- the article is not made from gold but rather from titanium or from platinum or from silver or from diamond or from another precious metal or not precious metal or from a mix of any one;
- at least one second linking element does not comprise a frame having a toric section but rather a frame having a rectangular section and the holes configured to receive the first linking elements are larger than the perimeter of the first linking elements;

at least one second linking element does not comprise a frame which surround each eye but rather a frame having a cross shaped, in other words a frame having a plurality of arms which each extend from a central base;

at least one second linking element does not comprise eyes but rather hooks configured to be taken with the first linking elements;

at least one second linking element is provided with a single piece of the article, in other word the single piece and the second linking element are made from a unique piece and the unique piece does not comprise first linking element;

the first linking elements do not project from the first panel but rather from the second lower panel;

both the first panel and the second lower panel comprise first linking elements;

the flange of the article does not project from the first panel but rather from the second lower panel;

the single pieces which face have not the same shape and outline but rather they have different shapes and outlines;

the article of jewelry does not comprise any axis of symmetry;

the single pieces have all the same shape and outline;

the pins are not formed with the first panel but rather they are initially distinct from the first panel and next fixed to it;

the pins are not disposed at the outline of the single pieces but rather they are disposed at the center of the single pieces;

the single pieces of the article have not a shape which allow to obtain a natural crocodile skin aspect but rather a natural snake skin aspect or a natural turtle skin aspect; and/or the article of jewelry described above is not a part of a handle bag but rather for instance a part of wrist watch strap or a part of necklace or a part of bracelet.

It should be noted more generally that the invention is not limited to the examples described and represented.

The invention claimed is:

1. A handle bag comprising:

at least one side formed by an article of jewelry made from a precious metal and having a crocodile skin appearance, said at least one side comprising:

a first panel having an outer face and an inner face opposite to the outer face, said first panel being formed by a plurality of first individual pieces;

a second panel that is distinct from said first panel and which faces said first panel, said second panel having an outer face and an inner face opposite to the outer face and being formed by a plurality of second individual pieces; each of said second individual pieces facing one of said first individual pieces;

first linking elements formed by a plurality of pins and a plurality of holes;

second linking elements formed by a plurality of frames having at least two eyes and being interposed between said first individual pieces and said second individual pieces;

wherein:

said first individual pieces and second individual pieces have different outlines and shapes and reproduce said crocodile skin appearance;

said pins have a predetermined width, project from said inner face of said first panel and are each formed with one of said first individual pieces;

said eyes of said frames each comprise an aperture with a diameter corresponding to said predetermined width of said pins and are each through by and each surround one of said pins, thus connecting at least two of said first individual pieces together and preventing said pins from moving transversely within said apertures;

each of said holes is formed in one of said second individual pieces and receives a free end of one of said pins situated on a respective first individual piece which faces a respective second individual piece, said pin received being rigidly assembled into said hole, thus connecting at least one of said first individual pieces and at least one of said second individual pieces together.

2. The article according to claim 1, wherein the second linking elements each engage at least two of said pins.

3. The article according to claim 2, wherein the second linking elements each assemble between two and six individual pieces of either first or second panels.

4. The article according to claim 2, wherein said first and second panels have each a plurality of individual pieces which are of different shapes.

5. The article according to claim 1, wherein the second linking elements are each configured to assemble between two and six individual pieces of either first or second panels.

6. The article according to claim 1, wherein said first and second panels have each a plurality of individual pieces which are of different shapes.

7. The article according to claim 1, wherein each of the individual pieces of said first panel has a similar outline to and faces a respective one of said individual pieces of said second panel.

8. The article according to claim 1, wherein said article has a generally rectangular shape comprising a middle zone and two lateral zones and the individual pieces in the middle zone have each an outline defining a perimeter which is similar to the perimeter defined by an outline of each of the individual pieces in the lateral zones.

9. The article according to claim 1, wherein said article has two lateral faces and a flange which projects from said first panel and covers partially said second panel.

* * * * *